United States Patent [19]

Pritchett

[11] 4,022,460

[45] May 10, 1977

[54] DOCUMENT JAM DETECTOR FOR COPIER

[75] Inventor: Wayne W. Pritchett, Fairfield, Conn.

[73] Assignee: Pitney-Bowes, Inc., Stamford, Conn.

[22] Filed: Feb. 5, 1976

[21] Appl. No.: 655,414

[52] U.S. Cl. ..... 271/258

[51] Int. Cl.$^2$ ..... B65H 7/14

[58] Field of Search ..... 271/173, 258, 259

[56] References Cited

UNITED STATES PATENTS

| | | | |
|---|---|---|---|
| 3,603,680 | 9/1971 | Barton | 271/259 X |
| 3,626,956 | 12/1971 | Sauder | 271/259 X |
| 3,693,969 | 9/1972 | Sakamaki et al. | 271/258 |
| 3,920,328 | 11/1975 | Toto et al. | 271/258 X |

*Primary Examiner*—Robert W. Saifer

*Attorney, Agent, or Firm*—Donald P. Walker; William D. Soltow, Jr.; Albert W. Scribner

[57] ABSTRACT

A circuit for detecting documents jammed at the entry to an image fixing station in a copier includes a latch-controlled timer. Energization of a paper feed clutch sets the latch to initiate a timing cycle. A photoelectric circuit indicates whether the trailing edge of a document being fed to the image fixing station has cleared the entry. The proper output from this circuit clears the latch and interrupts the timing cycle. If the timer times out before the entry is cleared, the timer output is driven to a jam-indicating state.

7 Claims, 4 Drawing Figures

POWER TO MACHINE
30 VAC
FUSER CIRCUITS
FLIP FLOP
OUTPUT STAGE
RESET PRESTART PULSE
DRIVE START
CLEAR
SET
RESET PRESTART
PAPER FEED

DOCUMENT JAM DETECTOR FOR COPIER

BACKGROUND OF THE INVENTION

The present invention relates to document reproducing apparatus and more particularly to a document jam detector for a copier.

A known type of image copier uses dry toner powder which is selectively applied to the surface of a sheet of plain paper to form the image copy. The powder is fixed or fused to the paper by applying heat. The amount of thermal energy transferred to the applied toner powder is important. If an insufficient amount of thermal energy is used, the toner powder particles will not be completly fused to the paper surface. The resulting copy can be readily smeared or erased. If too much thermal energy is applied, the paper will scorch or, under abnormal or fault conditions, catch fire.

Two variables control the amount of thermal energy transferred within such a copier. The first variable is the temperature at the image fixing station or fuser section of the copier. The second variable is the length of time the paper remains in the fuser. While the fusing temperature might be reduced to reduce the risk of scorching or fire, many toners in use today do not fuse well at reduced temperatures. Moreover, the fuser temperature can be reduced ony if the paper remains in the fuser for a long period of time. An inherent disadvantage of a longer fixing time is that the copier must operate at a slower speed.

For the reasons given above, higher fuser temperatures are preferred. Reliable paper flow becomes more critical at such higher, fuser temperatures.

While the possibility of jams in the paper flow path can be reduced through careful design, it cannot be completely eliminated. The possibility that documents may become jammed must still be considered in order to avoid having the paper catch fire within the fuser.

SUMMARY OF THE INVENTION

The present invention is a detector for detecting items jammed at the entry to a processing station of an item processing apparatus including actuatable means for feeding items to the station. The jam detector includes a resettable timer having a timing cycle of predetermined duration. The timer is adapted to produce a jam indicating signal if it completes the cycle. The timer is controlled by timer control means which respond to the energization of the actuatable means to initiate the timing cycle. The timer control means also responds to the trailing edge of an item entering the processing station to interrupt the timing cycle by resetting the timer.

DESCRIPTION OF THE DRAWINGS

While the specification concludes with claims particularly pointing out and distinctly claiming that which is regarded as the present invention, details and advantages of a particular embodiment of the invention may be more readily ascertained from the following detailed description when read in conjunction with the accompanying drawings wherein:

DETAILED DESCRIPTION

Figure 1:
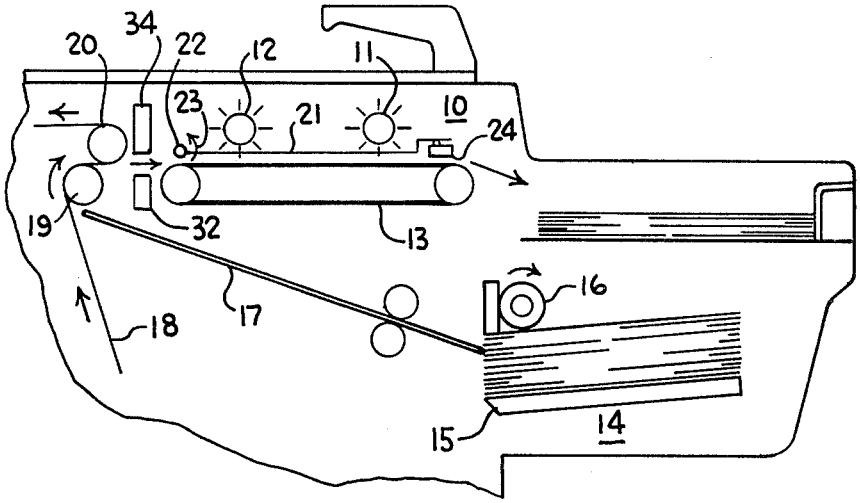
FIG. 1 is a side view of the section of a copier into which the present invention may be incorporated.

Referring to FIG. 1, the section of a document copier illustrated there includes an image fixing station or fuser 10 including a pair of heat-generating radiant lamps 11 and 12 and a paper transporting belt 13.

Blank sheets of copy paper are stored in a sheet feed area 14 including a paper tray 15. Individual sheets of paper are picked from the top of the stored stack by an intermittently energized paper-feed clutch which drives a roller 16 in a clockwise direction. Each sheet of paper picked from the paper tray 15 is driven along an inclined ramp 17 into contact with an endless web 18 which forces the sheet of paper in a clockwise direction about a roller 19. As the web 18 and a sheet of plain paper move about roller 28, a toned image on endless web 18 is transferred to the plain paper. While the individual sheets of paper enter the fuser 10, the endless web 13 is guided away from the fuser 10 by a second roller 20 about which the web is wrapped. A rack 21, extending over the endless web 13, is pivotally attached at one end 22 to the fuser 10 for rotation away from the web 13, as shown by the arrow 23. The other end 24 of the rack 21 rests upon switch 25 to hold its switching contact closed. In the event that a sheet of paper becomes jammed between the rack 21 and web 13, the rack 21 is pivoted off the switch 25 to open its switching contact. Thus the switch 25 may be used to signal a jam condition within the fuser 10.

The presence or absence of sheets of paper at the entry to the fuser 10 is detected by a photoelectric circuit which includes a photosensitive element 32 and a light source 34, both of which are shown only generally in FIG. 1. Both may be conventional components. The photoelectric circuit must be able to reject the high ambient levels of light produced by radiant lamps 12 and 11. Ambient light rejection can be accomplished by using a collimator tube on the photosensitive element 32 and, if necessary, by using an incandescent light source having a high axial intensity.

Figure 2:
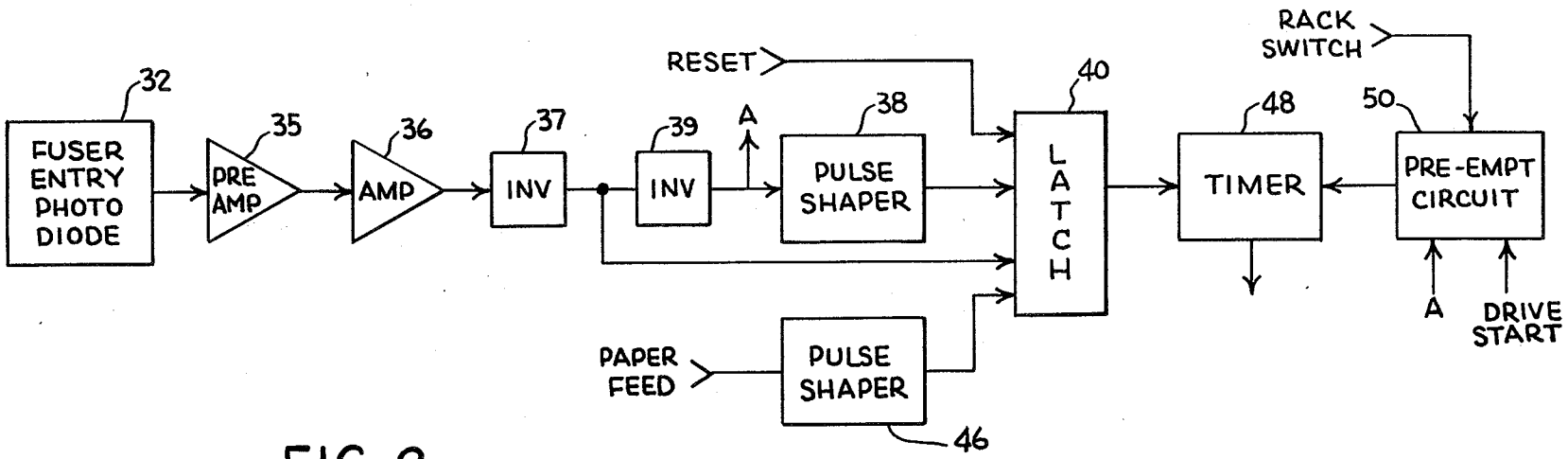
FIG. 2 is a block diagram of a detector constructed in accordance with the present invention.

Referring to FIG. 2 a circuit constructed in accordance with the present invention uses the signals generated by the photosensitive element 32 which, according to a preferred embodiment, is a photodiode. Photodiode signals are applied to a pre-amplifier 35 which, in turn, provides amplified forms of those signals to a comparator amplifier 36. The output of comparator amplifier 36 is inverted by inverter 37 before being applied to a set input of a bistable latch 40. After a second inversion in inverter 39, the amplifier output is shaped by a pulse shaper circuit 38, the output of which is connected to a Clear input of latch 40. A second Clear input to latch 40 is provided by a reset pulse source controlled by the user of the machine. Reset pulses provided by source 42 are used to restart the machine after a jam has been cleared. A second Set input to latch 40 is provided by a circuit including the control for the paper feed clutch. The energizing signal for the clutch is applied to a pulse shaper circuit 46. The resulting shaped pulse provides a second Set input to the latch 40. The output of latch 40 is applied to a timer 48 a timing cycle of predetermined duration.

When the latch 40 sets upon energization of the paper feed clutch, the latch output initiates this timing cycle. If the latch 40 is cleared by a negative going pulse from pulse shaper 38, which occurs when the trailing edge of a sheet of paper passes photodiode 32, the timing cycle is interrupted and the timer reset.

If the trailing edge of a sheet of paper does not clear the photodiode 32 before the timer completes its cycle; i.e., times out, the timer output is driven to a jam-indicating level. The jam-indicating signal is employed to terminate operation of the paper feed clutch, to turn off the radiant lamps 11 and 12 in the fuser area and to energize alarm lights.

Another input to timer 48 is provided by a circuit 50 identified as a preempt circuit. The preempt circuit operates when jam occurs within the fuser so as to cause the rack 21 to be pivoted away from the web 13 and thus off of switch 25, thereby opening its switching contact; or when sheets of paper continue to obstruct the fuser entrance as the machine is not copying; either of which conditions may cause the paper to catch fire. Under these conditions, the preempt circuit 50 causes the output of timer 48 to be driven immediately to a jam-indicating state.

Figure 3:
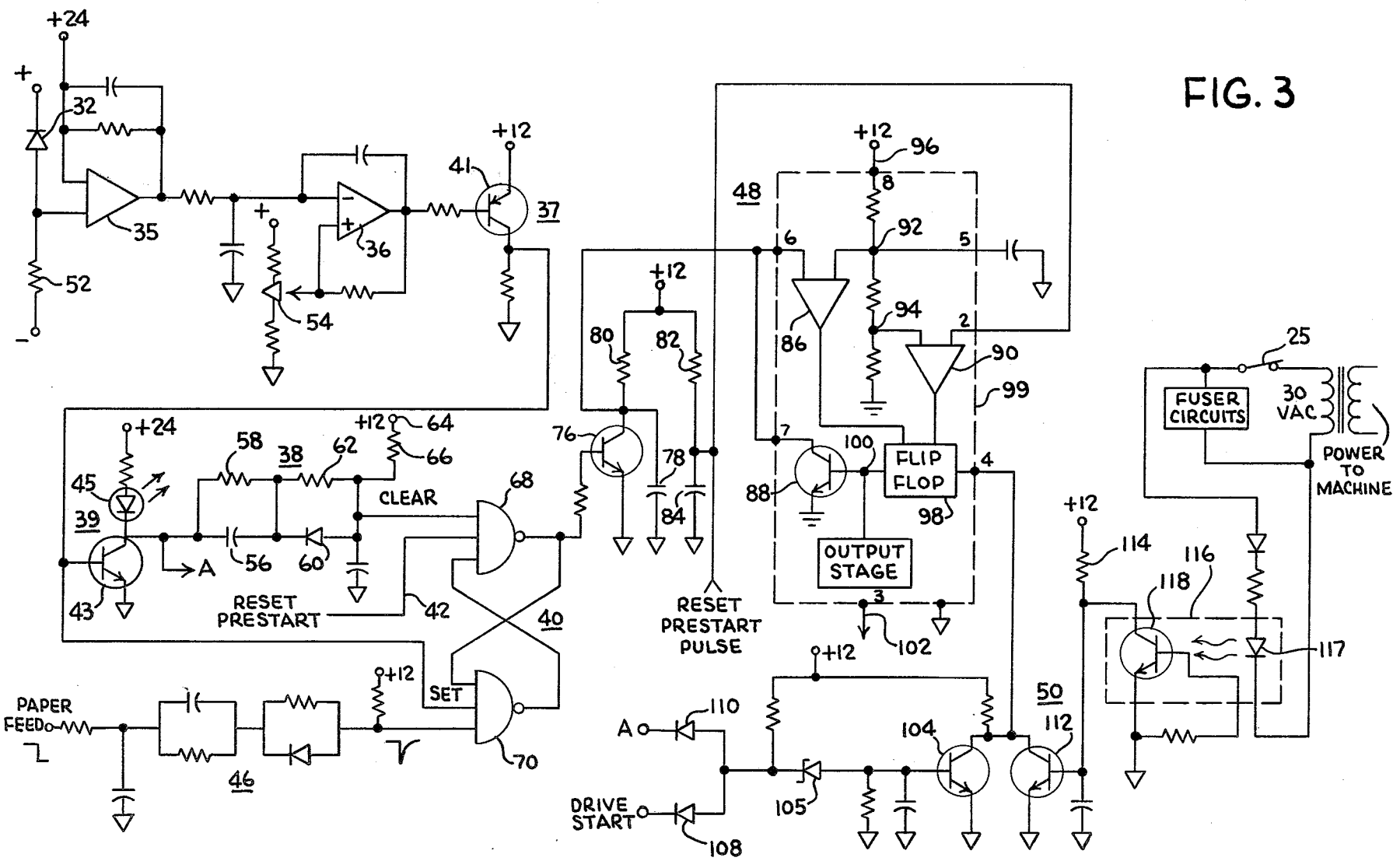
FIG. 3 is a detailed schematic diagram of the circuit shown in block diagram form in FIG. 2.

FIG. 3 illustrates, in detail, particular embodiments of each of the circuits described only generally above.

Photodiode 32 is connected in series with a resistor 52 between a positive voltage source and a negative voltage source. When a sheet of paper at the fuser entry obstructs the beam from light source 34, photodiode 32 exhibits high resistance, resulting in a relatively negative signal at the input to pre-amplifier 35. When the entry to the fuser is clear, allowing light from source 34 to impinge on photodiode 32, the photodiode resistance is low and the input to pre-amplifier 35 has a more positive value.

The pre-amplifier signals are applied to a negative input of the comparator amplifier 36. A positive or reference input to amplifier 36 is provided by means of an adjustable voltage divider 54. The output of amplifier 36 is basically a step function waveform having a high value when the fuser entry is obstructed and a low value when the fuser entry is cleared. This step function wave form is applied to the base terminal of a PNP transistor 41 in inverter 37. The inverted signal on the collector of transistor 41 is applied both to a Set input of latch 40 and to the base of an NPN transistor 43 in the second inverter 39. NPN transistor 43 has a light emitting diode 45 in its collector circuit. When transistor 43 is driven into its conductive state by a high level signal from the inverter transistor 41, light emitting diode 45 carries the collector circuit current and produces light, thereby indicating that the fuser entry is cleared. The twice inverted signal on the collector of transistor 43 is a step function which is converted to a short pulse by pulse shaping circuit 38 which includes, a capacitor 56 and a parallel resistor 58. The parallel combination of resistor 56 and capacitor 58 is connected in series with a second parallel combination including a diode 60 and a resistor 62. A 12 volt voltage source 64, is connected to one junction of diode 60 and resistor 62 through a bias resistor 66. The output of the pulse shaper circuit 38 provides one input to an AND-NOT gate 68 which, in combination with a second AND-NOT gate 70, comprises the bistable latch 40. The output of pulse shaper circuit 38 is a high signal while paper obstructs the photodiode, which goes low temporarily when the trailing edge of a piece of paper clears the fuser entry.

A second input to the AND-NOT gate 68 is provided by a reset pulse source which is not illustrated. The source may be manually controlled to permit an operator to initiate resetting. Normally, this input remains high, going low only when reset action is initiated by an operator. A third input to AND-NOT gate 68 is a cross-coupled connection from the ouput of the AND-NOT GATE 70.

Similarly, one of the inputs to AND-NOT gate 70 is provided by a cross-coupled connection from the output of the AND-NOT gate 68. A second input to AND-NOT gate 70 is provided by the output of the inverter 37. This input is a step function waveform which is low only when a sheet of paper is present at the entry to the fuser. A third input to AND-NOT gate 70 is provided by the pulse shaper circuit 46 connected in series with the source of a paper feed clutch control signal. Each time the clutch is energized to drive a sheet of paper towards the fusing station, a shaped negative-going pulse is provided by pulse shaper circuit 46 to AND-NOT gate 70. At other times this input remains at a high or binary one level.

The inputs to AND-NOT gate 70 are referred to as Set inputs, while the inputs to AND-NOT 68 are referred to as Clear inputs. The outputs of AND-NOT gate 68 is applied to the base terminal of a NPN transistor 76 in the timer 48. Transistor 76 forms a controllable by-pass for a timing capacitor 78 which is connected in series with a resistor 80 between a positive voltage source and a common bus. A second RC circuit, consisting of a resistor 82 and a capacitor 84, is connected between the same voltage source and the common bus. The voltage on capacitor 78 provides one input to a comparator amplifier 86 and to the collector of an NPN transistor 88, both of which are in a timing device. The voltage at the juncture of the resistor 82 and the capacitor 84 is applied to an input to another comparator amplifier 90. Second inputs to each of the comparator amplifiers 86 and 90 are provided by taps 92 and 94, respectively, to a reference voltage divider consisting of a series of resistors connecting a positive voltage source 96 and ground. The output of comparator amplifier 90 pre-sets a flip-flop 98 causing and output 100 of that flip-flop to go to or remain at a logic 1 level.

The output of flip-flop 100 is normally at a logic 1 level. However, if bistable latch 40 sets and stays set for a pre-determined period of time, during which the NPN transistor 76 is in a non-conductive state, the voltage which builds up across capacitor 78 will eventually exceed the voltage appearing on tap 92. Under these conditions, the output signal from the comparator amplifier 86 switches levels, driving the flip flop 98 into a reset state. When flip-flop 98 is in a reset stage, the relatively negative signal appearing on output lead 102 indicates that a jam has occurred. As indicated earlier, a jam indicating signal can be used to shut down the machine.

While the various components within dotted outline 99 have been described and discussed as discrete components, all are available in an integrated circuit package such as the NE 555V Timer sold by Signetics Corporation of Menlo Park, California. The small numbers adjacent the leads from the dotted outline 99 are the pin numbers for this Timer.

Under certain conditions, the risk of fire hazard may make it imprudent to wait for the timer 48 to time out before shutting down the machine. The preempt circuit 50 operates under these conditions to drive the timer output 102 immediately to a low or jam-indicating level. Preempt circuit 50 includes a first transistor 104, the base terminal of which is connected through a Zener diode 105 to a pair of diodes 108, 110 having a common anodic connection and independent cathode terminals. The cathode terminal of diode 108 is connected to a user-controlled source of a drive start signal which is a binary zero level signal. The cathode connection of diode 110 is connected to the output of inverter 39. The diodes 108 and 110 in combination with the transistor 104 provide a logical AND function. If the fuser entry is clear, as indicated by a binary zero signal on the output of inverter 39, when a drive start command is given, as evidenced by a binary zero signal at the cathode of diode 108, both diode 108 and diode 110 will be forward biased, causing transistor 104 to remain in a non-conductive state wherein the signal on the collector terminal is at a high or binary level. A high signal on the collector of transistor 104 has no effect on flip-flop 98.

If, however, the fuser entry is obstructed when the drive start command is not issued, diode 105 will become reverse biased causing transistor 104 to be driven from a non-conductive to a conductive state. The negative going increment in its collector voltage will immediately reset flip-flop 98 driving the output 100 to a low or jam-indicating state.

The preempt circuit 50 includes a second transistor 112, the base terminal of which is biased by means of a voltage divider including a resistor 114 and an optoisolator 116. The optoisolator 116, which may be a Monsanto type MCT2, includes a light emitting diode 117 and a photosensitive solid state device 118 which is energized when light from the diode 117 inpinges on the same. And, this occurs whenever the machine is energized and rack switch 25 is closed. If a jam exists within the fuser when power is applied to the copier, and the rack 24 pivots off of switch 25 to open its switching contact, the light emitting diode 117 no longer emits light. As a result, the collector-to-emitter resistance of device 118 will be high, causing transistor 112 to assume a conductive state. The decrease in collector voltage as the transistor is powered up will cause flip-flop 98 to be immediately reset.

Figure 4:
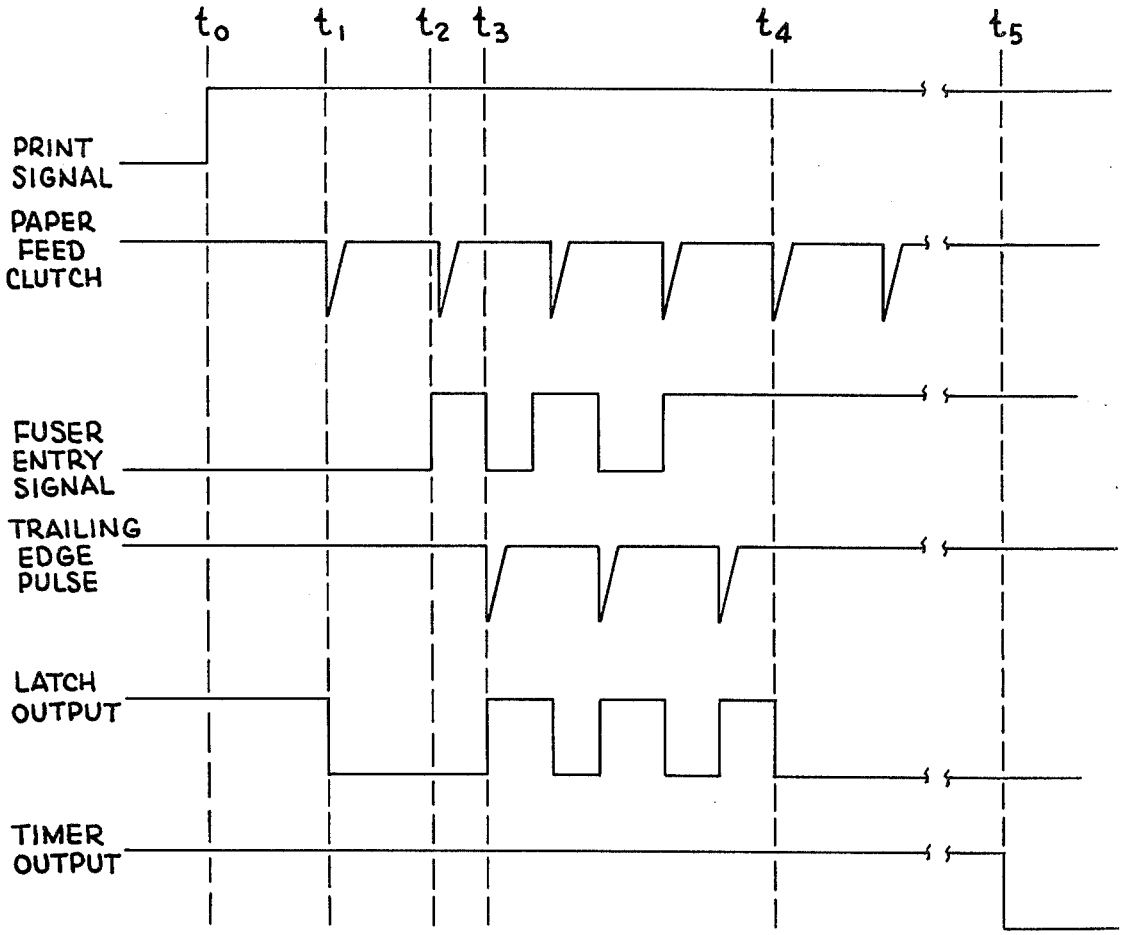
FIG. 4 shows wave forms generated at various points in the circuit during normal and fault mode of operation.

The operation of the circuit illustrated in FIG. 3, specifically the timing circuitry, is discussed with reference to the waveform shown in FIG. 4.

At a time arbitrarily designated as $t_0$ a print signal is generated to cause the previously powered-up but inactive copier to enter into a printing cycle. While many things happen in the course of this printing cycle, only the waveforms generated within the jam detector are shown and discussed. Early in the printing cycle, the paper feed clutch is energized to cause a sheet of paper to be driven toward the fuser area along inclined ramp 24. The clutch energization signal is actually a step function signal applied at the input of pulse shaper circuit 46. The pulses or spiked outputs of pulse shaper output 46 are illustrated in FIG. 4 with the first of the pulses occurring at a $t_1$. When the negative paper feed clutch pulse is applied to the AND-NOT gate 70, the output of that gate goes to a binary one level, causing the output of AND-NOT gate 68; i.e., the input to the timer, to fall to a binary zero level.

This low level input to the base terminal of the transistor 76 drives the transistor to a non-conductive state, removing an effective short circuit across timing capacitor 78. This allows the capacitor 78 to begin to charge toward a threshold level at which the flip-flop 98 in timer 48 will be reset. Where the sheet of paper which starts toward the fuser area at time $t_1$ reaches the fuser entry, the blocking of photosensitive element 32 drives the output of inverter 37 from a high to a low level. This negative-going signal has no effect on the AND gate 70 since the cross-coupled output from AND-gate 68 is already at a low level.

When the trailing edge of the paper clears the photocell, the outputs of comparator amplifier 36 and inverter 39 drop to a binary zero level. When the negative-going step function is applied to pulse shaper circuit 38, a negative pulse signal is generated. Prior to generation of this negative pulse, all inputs to the AND-NOT gate 68 had been at a binary 1 level. When the input from pulse shaper 38 goes temporarily negative, the output of AND-NOT gate 68 is driven to a binary one output level. This binary one signal is cross-coupled to the input of AND-NOT gate 70. Since the other two inputs to AND-NOT gate 70 were previously at binary 1 levels, the ouput of that gate goes to a binary 0 level.

This signals generated as the trailing edge of the paper clears the fuser entry cause latch 40 to clear. The binary one signal on the output of AND-NOT gate 68 causes the transistor 76 to conduct, forming a discharge path for timing capacitor 78. If capacitor 78 is discharged before reaching the threshold voltage the timing cycle is interrupted and flip-flop 100 remains set.

The pattern of operation described above will be repeated continuously so long as the copier continues to operate normally.

However, if a sheet of paper becomes jammed at the fuser entry, the detector circuit will produce a jam-indicating signal in the following manner. At a time $t_4$, a paper feed clutch pulse signal causes the latch 40 to be set with the resulting binary 0 output signal from AND-NOT gate 68 driving transistor 76 into non-conduction. Timing capacitor 78 will begin to charge as usual. If the sheet of paper does not clear the fuser entry, however, the voltage across capacitor 78 will eventually build to the threshold level set at terminal 92, driving the output of comparator amplifier 86 to the opposite level. As a result, flip-flop 98 will reset, causing the signal on its output 100 and at the timer output 102 to fall to the low or jam-indicating level. This is shown at time $t_5$ in FIG. 4.

While there has been described what is considered to be a preferred embodiment of the present invention, variations and modifications will occur to those skilled in the art once they become acquainted with the basic concepts of the invention. Therefore, it is intended that the appended claims shall be construed to include all such variations and modifications as fall within the true spirit and scope of the invention.

What is claimed is:

1. In a document processing apparatus having a processing station and actuatable means for feeding documents to the station, a document jam detector comprising: a resettable timer having a timing cycle of predetermined duration and adapted to produce a jam-indicating signal at the end of said timing cycle, and timer control means for initiating the timing cycle of said resettable timer and resetting said resettable timer, said timer control means including:

a. a bistable latch having a plurality of inputs and a single output to said resettable timer;

b. means responsive to the actuation of said actuatable means for applying a signal to one of said plurality of inputs to set said latch into one of its bistable states; and c. means responsive to the trailing edge of a document entering the processing station for applying a signal to another of said plurality of inputs to clear said latch to the other of its bistable states, wherein said trailing edge responsive means incudes:

i. a photoresponsive circuit at the entry to said processing station for producing a signal having one level while a document is present and another level while no document is present;

ii. a comparator amplifier connected to said photoresponsive circuit for comparing the output signal from said photoresponsive circuit against a reference signal to eliminate the effects of ambient light; and iii. a pulse shaping circuit having an input from said comparator amplifier and an output to said bistable latch.

2. The document jam detector as recited in claim 1 further including:

user-controlled means connected to said bistable latch for generating a reset signal to clear said bistable latch.

3. In a document copier having an image fixing station and a paper feed clutch which is intermittently energizable to drive sheets of paper in seriatim toward the image fixing station, a document jam detector comprising: a resettable timer having a timing cycle of predetermined duration and adapted to produce a jam indicating signal at the end of said timing cycle, and timer control means responsive to the energization of said paper feed clutch to initiate the timing cycle and responsive to the trailing edge of the next sheet entering the image fixing station to reset said resettable timer, said timer control means including:

a. a bistable latch having a plurality of inputs and a single output to said resettable timer;

b. means responsive to the energization of said paper feed clutch to set said latch into one of its bistable states; and c. means responsive to the trailing edge of the next sheet of paper to enter the image fixing station to clear said latch into the other of its bistable states, wheren said trailing edge responsive means includes:

i. a photoresponsive circuit having a detector at the entry to the image fixing station, said circuit being adapted to produce one level of signal when a sheet is present at the entry and another level of signal when no sheet is present at the entry ii. a comparator amplifier connected to photoresponsive circuit for comparing the circuit output to a reference signal to eliminate the effects of ambient light; and iii. a pulse shaping circuit having an input from said comparator amplifier and an output to said bistable latch.

4. The paper jam detector as recited in claim 3 further including:

user-controlled means connected to said bistable latch for generating a reset signal to clear said bistable latch.

5. The document jam detector as recited in claim 1 further including:

a preempt circuit having inputs from an operator controlled means and from a document present amplifier output and having an output to said resettable timer, said preempt circuit being responsive to the occurrence of a document-present amplifier output and the absence of a signal from the operator controlled means to drive said resettable timer immediately to a jam-indicating state.

6. The document jam detector as recited in claim 3 further including:

a preempt circuit having inputs from an operator controlled means and from a document present amplifier output and having an output to said resettable timer, said preempt circuit being responsive to the occurrence of a document-present output signal and the absence of a signal from the operator controlled means to drive said resettable timer immediately to a jam-indicating state.

7. The paper jam detector as recited in claim 6 wherein said preempt circuit further includes an input which carries a signal having a first level when a jam occurs within the image fixing station and a second level when no jam occurs, said preempt circuit being responsive to the first signal level to drive said resettable timer immediately to a jam-indicating state.

* * * * *

UNITED STATES PATENT AND TRADEMARK OFFICE

CERTIFICATE OF CORRECTION

PATENT NO. : 4,022,460

DATED : May 10, 1977

INVENTOR(S) : Wayne W. Pritchett

It is certified that error appears in the above-identified patent and that said Letters Patent are hereby corrected as shown below:

Column 8, line 1, change "wheren" to -- wherein --.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*